US011213886B2

(12) United States Patent
Uchida et al.

(10) Patent No.: US 11,213,886 B2
(45) Date of Patent: Jan. 4, 2022

(54) SOCKET INSTALLATION STRUCTURE OF REFRACTORY ARTICLE

(71) Applicant: KROSAKIHARIMA CORPORATION, Fukuoka (JP)

(72) Inventors: Yuuya Uchida, Fukuoka (JP); Hirotaka Itou, Fukuoka (JP); Yuuji Igawa, Fukuoka (JP); Hitoshi Nakamura, Fukuoka (JP)

(73) Assignee: KROSAKIHARIMA CORPORATION, Fukuoka (JP)

( * ) Notice: Subject to any disclaimer, the term of this patent is extended or adjusted under 35 U.S.C. 154(b) by 156 days.

(21) Appl. No.: 16/647,960

(22) PCT Filed: Sep. 12, 2018

(86) PCT No.: PCT/JP2018/033836

§ 371 (c)(1),
(2) Date: Mar. 17, 2020

(87) PCT Pub. No.: WO2019/065247

PCT Pub. Date: Apr. 4, 2019

(65) Prior Publication Data

US 2020/0246863 A1 Aug. 6, 2020

(30) Foreign Application Priority Data

Sep. 28, 2017 (JP) ..... JP2017-188710

(51) Int. Cl.
*B22D 41/58* (2006.01)
*B22D 1/00* (2006.01)
*B22D 11/117* (2006.01)

(52) U.S. Cl.
CPC ..... *B22D 41/58* (2013.01); *B22D 1/005* (2013.01); *B22D 11/117* (2013.01)

(58) Field of Classification Search
CPC ..... B22D 1/005; B22D 41/58
See application file for complete search history.

(56) References Cited

U.S. PATENT DOCUMENTS 7,942,455 B2 5/2011 Richard et al.

FOREIGN PATENT DOCUMENTS

CA 2475483 A1 * 2/2005 ..... B22D 41/58
JP 62-67663 4/1987

(Continued)

OTHER PUBLICATIONS

International Preliminary Report on Patentability dated Mar. 31, 2020 with English Written Opinion for PCT/JP2018/033836 filed Sep. 12, 2018.

(Continued)

*Primary Examiner* — Kevin E Yoon
(74) *Attorney, Agent, or Firm* — Paul D. Bianco; Gary S. Winer; Fleit Intellectual Property Law

(57) ABSTRACT

A socket installation structure of a refractory article is designed to prevent gas leakage therein. A first flange is provided between an outward end and an inward end of a socket, and a face of the first flange on the side of an inward end thereof is bonded to an article body of the refractory article through a sealing material. Further, a face of the first flange on the side of an outward end thereof faces a metal plate disposed around the outward end or a second flange provided on the side of the outward end, through a low thermally-conductive material layer made of a low thermally-conductive material having a thermal conductivity at room temperature of 40 (W/(m·K)) or less.

9 Claims, 5 Drawing Sheets

Inward side of article body ⇔ Outward side of article body

(56) References Cited

FOREIGN PATENT DOCUMENTS

| | | | |
|---|---|---|---|
| JP | 2001-087845 | A | 4/2001 |
| JP | 2002-001498 | A | 1/2002 |
| JP | 2006-516482 | A | 7/2006 |
| JP | 2010-227942 | A | 10/2010 |

OTHER PUBLICATIONS

International Search Report dated Nov. 2, 2018 for PCT/JP2018/033836 filed Sep. 12, 2018.
Written Opinion for PCT/JP2018/033836 filed Sep. 12, 2018.

* cited by examiner

Inward side of article body ⇔ Outward side of article body

Inward side of article body ⇔ Outward side of article body

Inward side of article body ⇔ Outward side of article body

Inward side of article body ⇔ Outward side of article body

Inward side of article body ⇔ Outward side of article body

Inward side of article body ⇔ Outward side of article body

Inward side of article body ⇔ Outward side of article body

Inward side of article body ⇔ Outward side of article body

Inward side of article body ⇔ Outward side of article body

Inward side of article body ⇔ Outward side of article body

SOCKET INSTALLATION STRUCTURE OF REFRACTORY ARTICLE

TECHNICAL FIELD

The present invention relates to a socket installation structure of a refractory article, such as a refractory nozzle or a refractory plug, having a function of injecting gas into molten metal or blowing out gas to a specific region.

BACKGROUND ART

In a refractory article, such as a refractory nozzle or a refractory plug, having a refractory article body (hereinafter referred to simply as "body" or "article body") internally provided with a means for gas flow, gas retention, gas pressure equalization or the like, such a void space including a slit, or a porous refractory material (this means will hereinafter be referred to simply as "gas pool"), it is common that a generally cylindrical-shaped socket having a gas introduction through-hole is installed in the article body or to a metal casing or the like surrounding the article body, and then a gas feed pipe is connected to the socket so as to introduce gas into the gas pool via the gas introduction through-hole.

In a structure where the gas feed pipe is connected to such a socket, there arises a problem that gas leaks from between the article body and the socket. If gas leakage occurs, it leads to nozzle clogging, deterioration in molten metal agitating performance by gas, etc., and thus deterioration in productivity, deterioration in slab quality, etc.

For example, in the following Patent Document 1, it is pointed out that, in a case where a socket is welded to a metal plate, due to expansion of the socket during welding, a gap is formed between the socket and a sealing material after the welding, or, due to welding heat, residual moisture and crystallization water in the sealing material are vaporized to cause foaming of the sealing material, resulting in the occurrence of gas leakage (paragraph [0007]).

With a view to preventing such gas leakage, the Patent Document 1 proposes a socket installation structure of a gas-injection continuous casting refractory article, wherein a socket is formed with a flange or raised portion on the side of a rear end thereof to which a gas feed pipe is connected, and installed in a socket hole of an article body of the refractory article through a sealing material.

In the Patent Document 1, there is the following description (paragraph [0015]): "a contact area between the flange or raised portion of the socket and the sealing material can be increased to provide larger resistance against external stress during screwing with the gas feed pipe, so that a crack becomes less likely to be formed in the sealing material, thereby effectively suppressing gas leakage during use. Further, the socket having the flange or raised portion is installed, so that there is no need for welding and thus there is no risk of a crack in the sealing material due to expansion of the socket during welding and foaming of the sealing material. On the other hand, even if a crack is formed in a portion of the sealing material in contact with an externally threaded portion of the socket, the flange or raised portion in strongly tight contact with the sealing material can effectively suppress gas leakage (paragraph [0015]).

Particularly, with a view to eliminating a negative influence of welding between a metal reinforcement plate and a socket to eliminate gas leakage during gas introduction, based on the technique disclosed in the Patent Document 1, the following Patent Document 2 discloses a method which comprises: providing a through-hole in the metal reinforcement plate at a position above a socket installation hole provided in a lateral surface of a nozzle body of a casting nozzle; and, after installing the socket in the socket installation hole through a sealing material and welding the metal reinforcement plate to the socket, additionally injecting a sealing material through the through-hole.

Further, the Patent Document 3 discloses a structure in which a second support element (9b) inserted into a cylindrical hole of an article body of a refractory article is disposed to sandwich a gasket (14) in cooperation with a first support element (13), and a rod (9a) is configured to allow the two support elements to come closer to each other so as to compress the gasket.

In this Patent Document 3, the two "support elements" each of which is equivalent to a flange are provided, respectively, on a distal end side of the "rod (9a)" which equivalent to a socket, i.e., on an inward side of the article body ("second support element (9b)"), and on an outward side of the article body ("first support element (13)"), to sandwich and compress the gasket (14) between the two flanges, so that a portion of the gasket extended in a radial direction of the socket is brought into tight contact with the article body, thereby preventing gas leakage.

CITATION LIST

Parent Document

Patent Document 1: JP 2002-001498A
Patent Document 2: JP 2001-087845A
Patent Document 3: JP 2006-516482A

SUMMARY OF INVENTION

Technical Problem

In the structures disclosed in the Patent Documents 1 and 2, as is evident from these Patent Documents themselves, a sealing material around an outer periphery of the socket (designated by, e.g., the reference sign 52 in the figures of the Patent Document 1, or the reference sign 8 in the figures of the Patent Documents 1 and 2) is incapable of preventing gas leakage.

Further, the structures disclosed in the Patent Documents 1 and 2 are intended to prevent gas leakage by a sealing material disposed between the article body and the flange or raised portion provided in the vicinity of a rear end of the socket, i.e., an outermost periphery of the article body, instead of a sealing material disposed around an outer peripheral surface of the socket. However, even if the techniques disclosed in the Patent Documents 1 and 2 are applied to a refractory article such as a refractory nozzle, it is still impossible to sufficiently prevent gas leakage.

The structure of the Patent Document 3 is intended to prevent gas leakage by sandwiching and compressing the gasket in an axis direction of the socket to cause the gasket to be extended in the radial direction and brought into tight contact with the article body. However, as with the Patent Documents 1 and 2, a sufficient degree of tight contact cannot be obtained only by such an outer peripheral surface of the socket and by a contact force of the gasket which is a radial component of a compressive force in the axis direction of the socket, and there is no sealing material between each of the two flanges and the article body, so that it is impossible to sufficiently prevent gas leakage.

A technical problem to be solved by the present invention is to prevent gas leakage in a socket installation structure of a refractory article.

Solution to Technical Problem

The causes for the problem that even the techniques disclosed in the Patent Documents 1 to 3 still fail to sufficiently prevent gas leakage would be as follows.

(1) In a case where the flange or raised portion is welded to a metal casing or the like around the outer periphery of the article body, the flange or stepped portion still deforms due to the welding heat, so that a gap is formed with respect to the sealing material.

(2) Moreover, the metal casing lies in such a manner that it surrounds an outer peripheral surface of the article body, and thereby the flange or raised portion is in an approximately unrestrained state in a direction toward the outer periphery of the article body, i.e., a radially outward direction of the article body. Thus, the flange or stepped portion is more likely to deform.

(3) In addition to heat during welding in the sections (1) and (2), heat received from the inside of the article body due to molten metal during use or from the outer periphery of the article body due to an installation environment (e.g., atmosphere surrounding the article body or outside the socket, and the arrangement and structure of a heat insulating material), and an uneven temperature distribution thereof, cause deformation or the like of the flange or raised portion.

(4) When the flange or raised portion is welded to the metal casing or the like around the article body, the sealing material is partially altered non-uniformly, so that a void space or the like is formed inside the sealing material.

(5) In addition to heat during welding in the sections (1) and (4), the sealing material is exposed to a high temperature of greater than 100° C., particularly to rapid heating, in a drying process, to cause moisture or the like inside the sealing material to be rapidly vaporized, so that a void space or the like is formed inside or around the sealing material.

The present invention provides a socket installation structure of a refractory article for eliminating the above causes. Specifically, the present invention relates to a socket installation structure of a refractory article having features described in the following sections (1) to (9).

(1) A socket installation structure of a refractory article having an article body, which comprises: a socket internally provided with a gas introduction through-hole for introducing gas to an inside of the article body and configured to allow a gas supply pipe to be connected to the gas introduction through-hole; and a metal plate disposed to surround a part or an entirety of the article body and lie around one end of the socket or the gas introduction through-hole on an outward side of the article body (this end will hereinafter be referred to simply as "outward end"), wherein the socket has a first flange at a position between the outward end and the other end of the socket or the gas introduction through-hole on an inward side of the article body (this end will hereinafter be referred to simply as "inward end"), and wherein a face of the first flange on the side of the inward end is bonded to the article body through a sealing material, and a face of the first flange on the side of the outward end faces the metal plate or a second flange provided to the socket on the side of the outward end with respect to the first flange, through a layer made of a low thermally-conductive material having a thermal conductivity at room temperature of 40 (W/(m·K)) or less (this layer will hereinafter be referred to as "low thermally-conductive material layer"), and wherein the metal plate and a part or an entirety of an outer periphery of the socket are joined together.

(2) The socket installation structure as described in the section (1), which satisfies the following formula 1: $\lambda \leq 0.1359\ L^2 - 0.7849\ L + 1.4793$—Formula 1, where L denotes a thickness (mm) of the low thermally-conductive material layer, and λ denotes a thermal conductivity (W/(m·K)) at room temperature of the low thermally-conductive material.

(3) The socket installation structure as described in the section (1) or (2), wherein the low thermally-conductive material is a material having a thermal conductivity at room temperature of 2.5 (W/(m·K)) or less.

(4) The socket installation structure as described in the section (1) or (2), wherein the low thermally-conductive material is a material having a thermal conductivity at room temperature of 0.5 (W/(m·K)) or less.

(5) The socket installation structure as described in the section (1) or (2), wherein the low thermally-conductive material is air.

(6) The socket installation structure as described in any one of the sections (1) to (5), wherein each of the face of the first flange on the side of the inward end, and a face of the article body in contact with the face of the first flange through the sealing material, has a conical shape which extends from its starting point on an inward side toward an outward side of the gas induction through-hole, at an angle of greater than 0 degree to less than 90 degrees with respect to a central axis of the gas introduction through-hole.

(7) The socket installation structure as described in the section (2), wherein the thickness L (mm) of the low thermally-conductive material layer satisfying the formula 1 is a length including a socket axis directional length variation ΔL (mm) which is determined according to an angle θ (degree) of the face of the first flange located on the side of the inward end and in contact with the article body through the sealing material, with respect to an axis direction of the socket, and a length variation Δt (mm) of a thickness of the sealing material between the face of the first flange on the side of the inward end and the article body, in a direction perpendicular to the face of the first flange on the side of the inward end.

(8) The socket installation structure as described in the section (7), wherein the ΔL satisfies the following formula 2:

$$\Delta L \leq 5.76 \times \Delta t / \sin\theta \qquad \text{Formula 2}$$

(9) The socket installation structure as described in the section (7) or (8), wherein the ΔL is 23 mm or less, and the L is 43 mm or less.

Effect of Invention

First of all, a sealing section exerting an influence most directly on gas leakage behavior is provided at a position farthest from the outer periphery of the article body, i.e., on the inward side of the article body. In other words, the first flange is provided as close to the inward end as possible at a position between the outward end and the inward end of the socket, and the sealing material is provided between the face of the first flange on the side of the inward end and the article body.

That is, a sealing function is not substantially given or strengthened in a region between a portion of the socket around the outward end which is likely to undergo deformation (hereinafter referred to also as "on the side of the outer periphery of the article body") and the metal plate. In addition, the first flange is located inside the article body, so that there is an advantageous effect in that, even if the first flange receives a certain level of heat from the inside (hereinafter referred to also as "inner side") of the article body or the outside (hereinafter referred to also as "outer peripheral side") of the article body, the first flange expands in a radial direction thereof approximately evenly, so that non-uniform deformation becomes less likely to occur, and thus a gap becomes less likely to be formed in an interface between the first flange and the sealing material, thereby making it possible to enhance sealability in the radial direction, and strongly fix the first flange to the article body through the sealing material.

At the same time, local heat receiving of the sealing material and partial alteration due to the local heat receiving become less likely to occur.

Further, assume that a mechanical force is applied to the socket in the radial direction with respect to the axis thereof in the vicinity of the outer peripheral surface of the article body. Even in this situation, separation or the like in the sealing section due to an external force such as a moment applied to the socket is less likely to occur, because the sealing section is located at a position on the inner side of the article body, which is far away from the outer peripheral surface of the article body, and formed with an area greater than the cross-sectional area of the socket so as to allow the socket to be strongly fixed to the article body through the sealing material.

Further, the face of the first flange on the side of the outward end is disposed to face the metal plate on the side of the outer periphery of the article body or the second flange provided on the end of the socket on the side of the outer periphery of the article body, through the low thermally-conductive material layer, thereby minimizing thermal conduction from the inner side of the article body to the first flange. This makes it possible to further suppress non-uniform deformation of the first flange. Particularly, even if a local high-temperature state occurs due to an environment of external high-temperature or non-uniform atmosphere caused by, e.g., particularly, rapid exposure to a temperature of greater than 100° C., during welding operation or in a drying process after installation of the socket, an environment of uneven heat insulating material arrangement, or the like, it is possible to suppress an action of thermal conduction which unevenly acts on the first flange or to rapidly raise the temperature of the sealing section such that moisture or the like inside the sealing section is rapidly vaporized.

As above, the socket installation structure of the present invention can provide enhanced sealability between the socket and the article body, so that the need to ensure strict sealability between the first flange and the metal casing on the side of the outer periphery of the article body through the low thermally-conductive material layer becomes lower.

Thus, the need to weld the entire periphery of the socket (or the second flange on the side of the outer periphery of the article body) to the metal casing on the side of the outer periphery of the article body becomes lower. Specifically, the socket (or the second flange on the side of the outer periphery of the article body) may be weldingly fixed to the metal casing on the side of the outer periphery of the article body, at, e.g., one to three or more points. Here, the number of welding points can be minimized to the extent that deformation, displacement or the like do not occur. This makes it possible to reduce a heat load on the sealing section, and reduce deformation or the like of the socket (or the second flange on the side of the outer periphery of the article body) and the metal casing on the side of the outer periphery of the article body, thereby improving efficiency of socket installation.

BRIEF DESCRIPTION OF DRAWINGS

FIGS. 1A to 1C are schematic sectional views taken along a plane passing through a central axis of a gas introduction through-hole provided inside a socket, showing some examples of a socket installation structure of a refractory article according to the present invention, in which a sealing section extends along a plane perpendicular to an axis direction of the socket, wherein: FIG. 1A shows an example where a first, inward, flange of the socket is disposed at a position relatively close to an outer periphery of an article body of the refractory article, and an inward end of the socket on an inward side of the article body is disposed inside the article body; FIG. 1B shows an example where the first, inward, flange of the socket is disposed at a position relatively close to the outer periphery of the article body, and the inward end of the socket is extended to reach a gas pool provided inside the article body; and FIG. 1C shows an example similar to that in FIG. 1B, wherein the first, inward, flange is provided more inwardly to allow the length of a low thermally-conductive material layer to be increased.

FIGS. 2A and 2B are schematic sectional views taken along a plane passing through a central axis of a gas introduction through-hole provided inside a socket, showing some examples of a socket installation structure of a refractory article according to the present invention, in which a sealing section extends along a plane inclined with respect to an axis direction of the socket, wherein: FIG. 2A shows an example where a first, inward, flange of the socket is disposed at a position relatively close to the outer periphery of the article body, and an inward end of the socket on the inward side of the article body is disposed inside the article body; and FIG. 2B shows an example where the first, inward, flange of the socket is provided more inwardly, as compared with the example in FIG. 2A, to allow the length of the low thermally-conductive material layer to be increased, and the inward end of the socket is extended to reach the gas pool provided inside the article body.

FIGS. 3A and 3B are schematic sectional views taken along a plane passing through a central axis of a gas introduction through-hole provided inside a socket, showing some examples of a socket installation structure of a refractory article according to the present invention, in which a sealing section extends along a plane inclined with respect to an axis direction of the socket, to reach an inward end of the socket, wherein: FIG. 3A shows an example where a first, inward, flange of the socket is disposed at a position relatively close to the outer periphery of the article body, and an inward end of the socket on the inward side of the article body is disposed inside the article body; and FIG. 3B shows an example where the first, inward, flange of the socket is provided more inwardly, as compared with the example in FIG. 3A, to allow the length of the low thermally-conductive material layer to be increased, and the inward end of the socket is extended to reach the gas pool provided inside the article body.

DESCRIPTION OF EMBODIMENTS

Figure 1A:
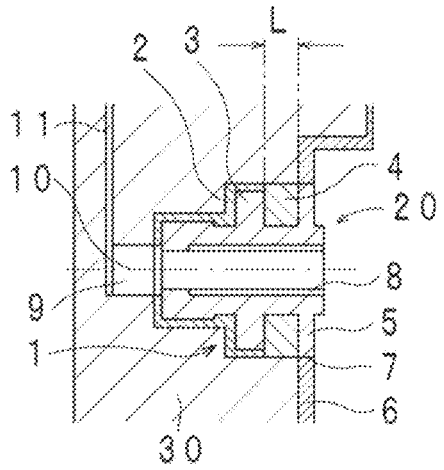

As mentioned above, one cause for gas leakage around a socket in a socket installation structure of a refractory article such as a refractory nozzle is deformation of a part of the socket or alteration of a sealing material. Particularly, in a case where an outer periphery of an outermost portion of the socket is welded to a metal plate provided around an outer periphery of a cylindrical article body of the refractory article, due to heat during the welding, a part of the socket deforms to form a gap with respect to the sealing member, or the temperature of the sealing member containing water is rapidly raised to a vaporization temperature or more of water, i.e., 100° C. or more to form, inside the sealing material, defects such as pores allowing gas to pass therethrough.

Further, generally, after installing the sealing material, with a view to removal of water contained in the sealing material and improvement in strength of the sealing material, the article body (including the socket installation structure) is subjected to heat treatment such as drying.

In addition to the above cause due to welding, rapid thermal conduction from an outer periphery of the article body during such heat treatment such as drying is also likely to cause the deformation or alteration.

The present invention is intended to prevent a situation where, due to heat such as welding heat from the outer periphery of the refractory body, i.e., from the outside of the socket, volatile matters such as water contained in the sealing material are rapidly vaporized to cause breaking of the microstructure of the sealing material.

A material of the socket, i.e., a ferrous metal, has a thermal conductivity at room temperature of about 70 to 80 (W/(m·K)). As seen in many convectional socket installation structures, the diameter of a socket is maintained at approximately the same value between axial opposite ends thereof, and, in a case where a sealing member is provided at each of the ends, a sealing face is set within the range of the diameter.

Compared with this, in the present invention, a low thermally-conductive material layer is formed between axial opposite ends of the socket to suppress thermal conduction in the axis direction of the socket, thereby preventing rapid temperature rise in a sealing section.

In this temperature range, the transfer of heat is mainly based on conduction, and radiation and convection are ignorable.

Although the low thermally-conductive material may have any thermal conductivity lower than that of a material of the socket, i.e., a ferrous metal, it preferably has the lowest possible thermal conductivity, because such a material is less likely to be influenced by fluctuation of thermal conditions, thereby more reliably obtaining the intended effect.

Through unsteady thermal calculation, the inventors have found that, under the condition that the temperature of a sealing material in contact with a first flange provided on the side of an inward end of the article body is kept at 100° C., a thermal conductivity λ (W/(m·K)) at room temperature of the low thermally-conductive material satisfies the following formula 3, in relation to a socket axis directional thickness L (mm) of the low thermally-conductive material layer:

$$\lambda=0.1359L^2-0.7849L+1.4793 \qquad \text{Formula 3}$$

That is, a temperature of the sealing material never exceeds 100° C. by using a low thermally-conductive material having λ equal to or less than the λ in the formula 3, i.e., having λ whose value≤(right-hand side of the formula 3). A formula expressing this relation is the aforementioned formula 1.

Figure 6:
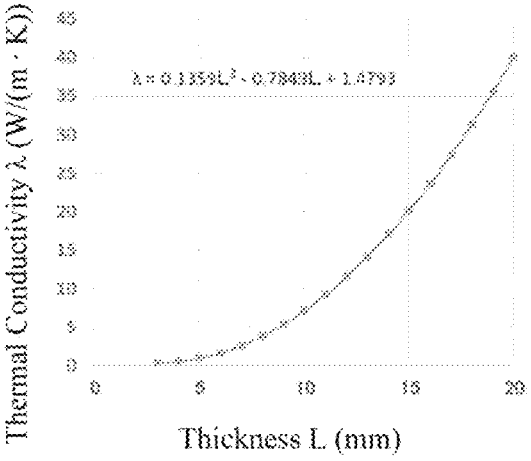
FIG. 6 is a graph showing a thermal conductivity λ (W/(m·K)) at room temperature of a low thermally-conductive material in relation to a socket axis directional thickness L (mm) of the low thermally-conductive material layer, under the condition that the temperature of a sealing material is kept at 100° C. (based on formula 3).

The relationship between L and λ based on the formula 3 is shown in FIG. 6.

The formula 3 is based on values measured during actual operation of welding the entire periphery of the socket to the metal casing on the side of the outer periphery of the article body. Although the time period of this welding operation varies depending on a welding method, it is about 10 seconds to about several ten seconds at a maximum.

In this calculation, the temperature of a welding area was set to 600° C. (which is a value measured by a thermoviewer, and the bulk specific gravity of the low thermally-conductive material was set to 3.0. When the bulk specific gravity is less than this value, λ becomes smaller with respect to the same L.

Paraphrasing this result, the thickness L is a matter of design choice, i.e., may be arbitrarily determined and set according to the structure, shape, etc., of the article body, and, by selecting a material having a thermal conductivity satisfying the formula 1 according to such a thickness, the temperature of the sealing material can be kept at about 100° C. or less, so that it is possible to install the socket so as to prevent formation of defects in the sealing material.

In the present invention, a maximum thickness of the low thermally-conductive material layer required when a maximum thermal conductivity of a refractory material is set to 40 (W/(m·K)) is calculated as about 20 mm based on the formula 2, and the thickness L (mm) can be set to the extent that it satisfies the formula 1 according to the thermal conductivity.

In a case where the sealing material contains a liquid other than water, such as a solvent, the temperature of the sealing material is basically set based on a vaporization temperature of the solvent, as in the case of water. Generally, the vaporization temperature of a non-aqueous solvent for use in a refractory material, is greater than 100° C. Thus, as long as the sealing material containing a non-aqueous solvent satisfies the formula 1 formulated based on 100° C., defects are less likely to be formed in the sealing material.

From a viewpoint of more reliably suppressing a temperature rise of the sealing material, the thermal conductivity of the material used for the low thermally-conductive material layer is preferable set to the lowest possible value. For example, it is preferable to use a material other than metal, carbon, a strongly-covalent compound and the like, such as a refractory material consisting mainly of an oxide, and particularly, considering easiness of installation, to use a material having a thermal conductivity at room temperature of about 2.5 (W/(m·K)) or less, such as mortar including alumina mortar, alumina-silica mortar and silica mortar.

In the socket installation stricture, the low thermally-conductive material layer does not have a function of supporting the socket, i.e., needs not withstand a mechanical stress, so that it may be made of a low-strength material such as a heat insulating material, inorganic fibers or a mixture thereof having a thermal conductivity at room temperature of about 0.5 (W/(m·K)) or less.

Further, most preferably, the low thermally-conductive material is air which has a significantly low thermal conductivity at room temperature of about 0.024 (W/(m·K)), i.e., the low thermally-conductive material layer is a void space, from a viewpoint of providing a highest heat insulating effect, and producing the socket installation structure easily and at low cost.

The above thermal conductivity was measured in accordance with JIS R2251.

Each of a face of the first flange provided between an outward end and an inward end of the socket and on the side of the inward end, and a face of the article body in contact with the face of the first flange through the sealing material, may be formed in a conical shape whose diameter gradually increases toward an outward side of the gas induction through-hole, with respect to a central axis of the gas introduction through-hole (which is coaxial with the axis of the socket). That is, each of the faces may be formed in a shape which extends from its starting point on an inward side toward the outward side of the gas induction through-hole, at an angle (hereinafter also referred to as "inclination angle") of greater than 0 degree to less than 90 degrees with respect to the central axis of the gas introduction through-hole.

Thus, when an external force is applied to the socket in the axis direction of the socket, the socket is moved toward the ventral axis of the gas induction through-hole of the article body, so that a thickness between an outer peripheral surface of the socket and the article body is uniformized, thereby providing enhanced uniformity of the sealing material.

Further, although the socket expands when heat is applied thereto during use, etc., the expansion of the socket is greater than that of the article body, so that the inclined face of the socket can provide enhanced contactability with respect to a layer of the sealing material while avoiding local stress concentration, thereby reducing the risk of breaking of the article body around the socket.

Figure 3A:
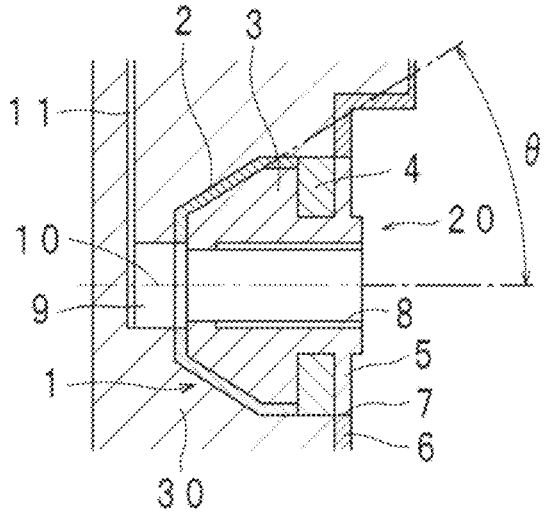
Figure 3B:
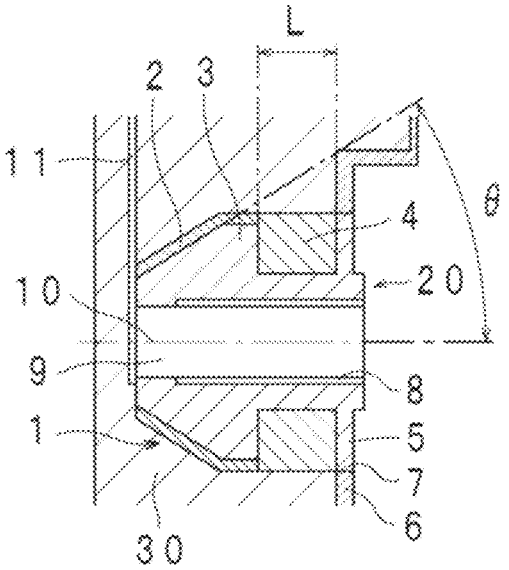

The first flange is preferably formed such that the inclined portion thereof extends up to the inward end of the socket (see FIGS. 3A and 3B). In this case, a non-inclined region (parallel to the axis of the socket) of the outer peripheral surface of the socket is reduced, so that the socket can be easily installed at a high degree of accuracy. Further, a portion of the sealing material between the inward face of the first flange and the contact face of the article body, which is important for sealability, is broadened and uniformized, so that it is possible to more enhance the sealability.

Figure 1B:
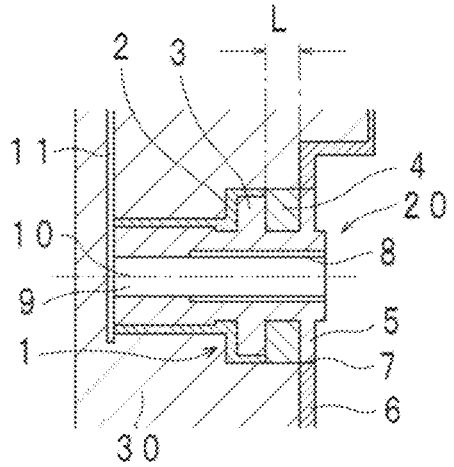
Figure 1C:
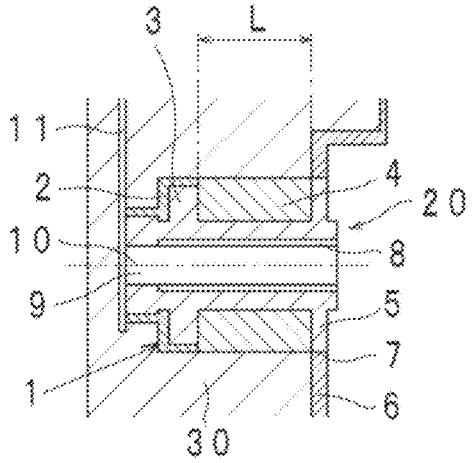
Figure 2A:
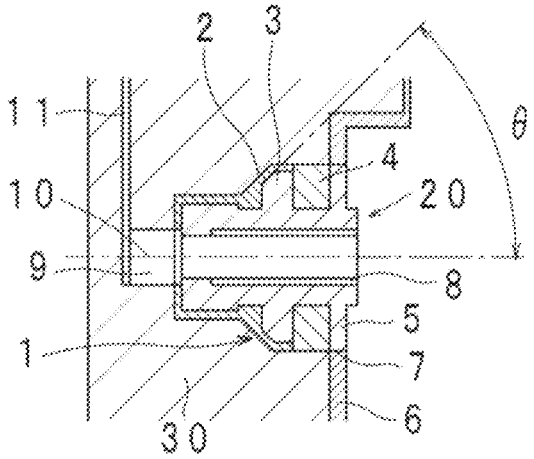
Figure 2B:
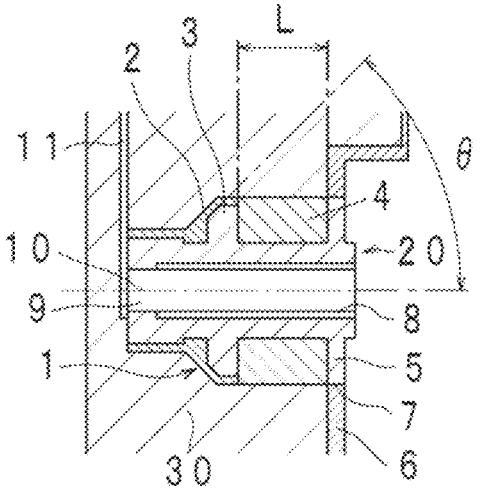

From a viewpoint of enhancing the heat insulating effect, the socket axis directional thickness L of the low thermally-conductive material layer is preferably increased as long as possible, and the first flange on the inward side of the article body is preferably provided inwardly as far as possible (see FIGS. 1C, 2B and 3B).

Further, when the first flange on the inward side of the article body is provided inwardly as far as possible, it is possible to stabilize a socket fixation force against an external force from the outside of the socket. For the same region, the length of the socket itself, i.e., the length between the outward end and the inward end of the socket, is preferably increased as long as possible (see FIGS. 1B, 2B and 3B).

The above inclination angle θ may be set appropriately and arbitrarily, according to the size of the first flange, the diameter and accuracy of a socket-installation recess of the article body, the accuracy of the sealing face of each of the socket and the article body, and others.

The thickness of the sealing material can vary depending on the configuration/properties of the sealing material, allowable errors in shape specifications of the socket and the article body, variation in operation during socket installation, and others.

Such a phenomenon is more likely to occur, in a case where a second flange to be provided on the side of the outward end of the socket is prepared separately from the remaining portion of the socket, and after installing the remaining portion, the second flange is installed to the socket or the metal plate by welding or other fixing means.

In the case where the sealing face of each of the first flange and the article body is configured as an inclined face, as the inclination angle θ (degree) of the sealing face becomes smaller, a length variation ΔL (mm) of the sealing material in the axis direction of the socket with respect to a thickness variation Δt (mm) of the sealing material in a direction perpendicular to the sealing face, i.e., a variation in position of the socket in a radial direction of the article body, becomes larger.

The ΔL and Δt geometrically have the relationship expressed as the following formula 4:

$$\Delta L = \Delta t / \sin\theta \qquad \text{Formula 4}$$

Figure 7:
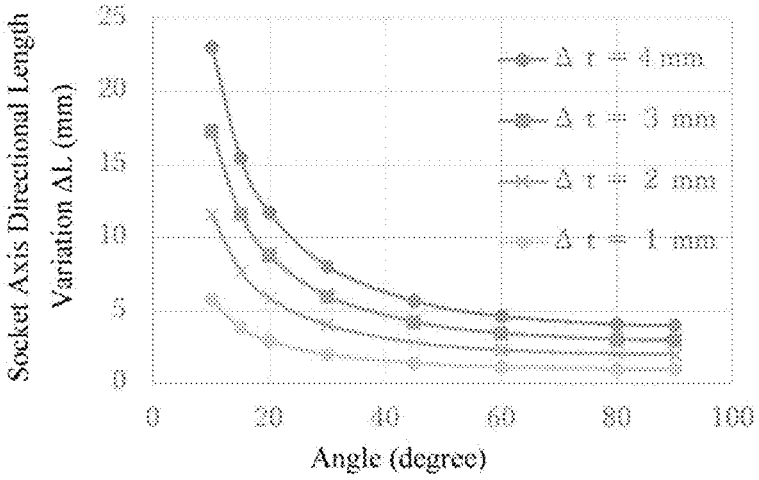
FIG. 7 is a graph showing a relationship between the angle θ (degree) of a sealing face and a socket axis directional length variation ΔL (mm) of the sealing material, with respect to each thickness variation Δt (mm) in a direction perpendicular to the sealing face.

A relationship between ΔL and θ in each case where Δt is set to 1, 2, 3 and 4 (mm) is shown in FIG. 7.

For example, in a case where the inclination angle θ is set to 10 (degree) which is considered to be realistically a minimum value, and the thickness variation Δt (mm) of the sealing material in a direction perpendicular to the sealing face, is set to 4 (mm) which is considered to be realistically a maximum value, the socket axis directional length variation ΔL (mm) is about 23 (mm).

Figure 8:
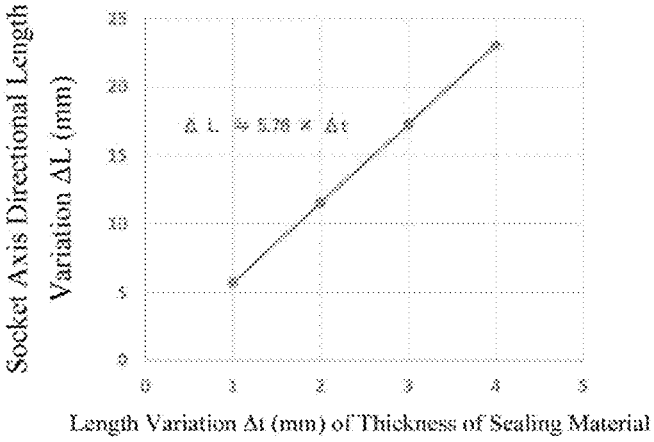
FIG. 8 is a graph showing a relationship between ΔL (mm) and Δt (mm), when the angle θ is 10 (degree) in FIG. 7, i.e., when ΔL (mm) has a maximum value.

For example, the relationship between ΔL and Δt in a case where the value of Δt at an inclination angle θ=10 (degree) varies is expressed as the following formula 5, as shown in FIG. 8.

$$\Delta L = 5.76 \times \Delta t \qquad \text{Formula 5}$$

As above, L (mm) in the formula 2 preferably includes the ΔL (mm) which is calculated according to the relationship between the inclination angle θ, and the thickness variation Δt (mm) of the sealing material in a direction perpendicular to the sealing face.

Integrating the formulas 4 and 5 into a single formula, the aforementioned formula 2: $\Delta L \leq 5.76 \times \Delta t / \sin\theta$ is obtained.

From viewpoints of: (1) increasing the area of the sealing section; (2) ensuring or enhancing the heat insulating effect of the low thermally-conductive material layer; and (3) enhancing mechanical stability against an external force applied to the socket, the size of the first flange is preferably increased as large as possible.

In this case, the first flange may be formed in a size enough to avoid causing breaking of the article body of the refractory article such as a refractory nozzle or a refractory plug, in relation to a shape such as the degree of curve of a portion of the article body corresponding to the first flange, (i.e., a curvature in a case where the portion has a circular shape), a distance from an end of the first flange, etc. Further, in the case where the portion of the article body corresponding to the first flange has a circular shape, the first flange may be curved in conformity with the curvature thereof.

A part or the entirety of the outer periphery of the socket needs to be joined and fixed to the metal plate on the side of the outer periphery of the article body.

As this joining method, it is possible to employ an appropriate technique, such as: spot welding of a part of the outer periphery of the socket; welding all around the outer periphery of the socket; or thread engagement through a thread joint structure formed between the socket and the metal plate. The outer periphery of the socket and the metal plate on the side of the outer periphery of the article body need not necessarily be kept in a tightly sealed state therebetween, but are only necessary to be fixed to each other.

Figure 4:
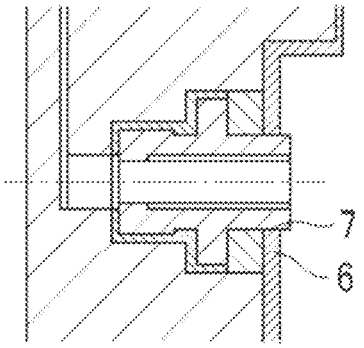
FIG. 4 is a schematic sectional view taken along a plane passing through a central axis of a gas introduction through-hole provided inside a socket, showing an example of a socket installation structure of a refractory article according to the present invention, which is devoid of a second flange to be provided on the side of an outward end of the socket.
Figure 5:
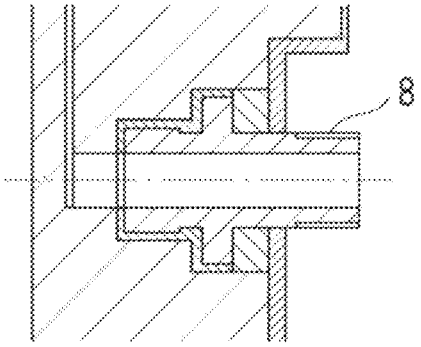
FIG. 5 is a schematic sectional view taken along a plane passing through a central axis of a gas introduction through-hole provided inside a socket, showing an example of a socket installation structure of a refractory article according to the present invention, in which an externally-threaded portion is provided in an outer periphery of one end of the socket on an outward side of the article body.

This fixed position may be at the outer periphery of the socket (designated by the reference sign 7 in FIG. 4), or may be at an outermost periphery of a second flange additionally provided on the outer periphery of the socket (designated by the reference sign 7 in FIGS. 1A-C to 3A and B).

EXAMPLES

Example A

Figure 9:
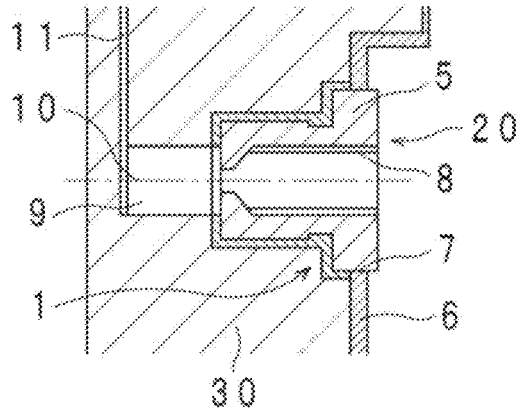
FIG. 9 is a schematic sectional view taken along a plane passing through a central axis of a gas introduction through-hole provided inside a socket, showing an example of a socket installation structure of a conventional refractory article.

With regard to: an inventive example 1 having the structure as shown in FIGS. 1A-C, wherein the socket axis directional thickness of the low thermally-conductive material layer was set to 10 mm, and the low thermally-conductive material was composed of an alumina mortar having a thermal conductivity at room temperature of about 2.5 (W/(m·K)); an inventive example 2 having the structure as shown in FIGS. 1A-C, wherein the socket axis directional thickness of the low thermally-conductive material layer was set to 10 mm, and the low thermally-conductive material was composed of a heat insulating material having a thermal conductivity at room temperature of about 0.5 (W/(m·K)); and a inventive example 3 having the structure as shown in FIGS. 1A-C, wherein the socket axis directional thickness of the low thermally-conductive material layer was set to 10 mm, and the low thermally-conductive material was composed of air, the presence or absence of air leakage was checked and compared with each other by a laboratory test at room temperature, together with a comparative example 1 having a conventional structure as shown in FIG. 9.

The entire outer periphery of the socket was welded to the metal plate on the side of the outer periphery of the article body.

The pressure of compressed air for checking air leakage was set up to 0.5 MPa. When there is a pressure drop after leaving for 3 hours, the example was evaluated as having air leakage, and, when there is no pressure drop after leaving for 3 hours, the example was evaluated as having no air leakage.

As a result, the comparative example 1 had air leakage, whereas each of the inventive examples 1 to 3 had no air leakage.

Example B

Example B shows a result obtained by subjecting the inventive example 3 and the comparative example 1 to actual casting operation, wherein the refractory article was formed as an upper nozzle for continuous casting.

As a result, the comparative example had a leakage occurrence frequency of about 3%, whereas the inventive example 3 had no leakage, i.e., a leakage occurrence frequency of 0%.

LIST OF REFERENCE SIGNS

1: sealing section having the most enhanced contactability in a region in which a sealing material is filled
2: sealing material
3: first flange provided on an inward side of an article body of a refractory article
4: low thermally-conductive material layer
5: second flange provided on an outward side of the article body
6: metal plate provided on the side of an outer periphery of the article body
7: joint area between a socket and the metal plate provided around the outer periphery of the article body
8: threaded portion
9: gas introduction through-hole
10: axis of the gas introduction through-hole and the socket
11: gas pool
20: socket
30: article body
L: thickness of the low thermally-conductive material layer from the second flange provided on the outward side of the article body or the metal plate provided on the side of the outer periphery of the article body
θ: angle of an inclined portion of the first flange provided on the inward side of the article body

The invention claimed is:

1. A socket installation structure of a refractory article having an article body, comprising:

a socket internally provided with a gas introduction through-hole for introducing gas to an inside of the article body and configured to allow a gas supply pipe to be connected to the gas introduction through-hole; and a metal plate disposed to surround a part or an entirety of the article body and lie around one end of the socket or the gas introduction through-hole on an outward side of the article body (this end will hereinafter be referred to simply as "outward end"), wherein the socket has a first flange at a position between the outward end and the other end of the socket or the gas introduction through-hole on an inward side of the article body (this end will hereinafter be referred to simply as "inward end"), and wherein a face of the first flange on the side of the inward end is bonded to the article body through a sealing material, and a face of the first flange on the side of the outward end faces the metal plate or a second flange provided to the socket on the side of the outward end with respect to the first flange, through a layer made of a low thermally-conductive material having a thermal conductivity of 40 (W/(m·K)) or less at room temperature, and wherein the metal plate and a part or an entirety of an outer periphery of the socket are joined together.

2. The socket installation structure as claimed in claim 1, wherein the structure satisfies the following formula 1:

$$\lambda \leq 0.1359L^2 - 0.7849L + 1.4793 \quad \text{Formula 1}$$

where L denotes a thickness (mm) of the layer, and λ denotes a thermal conductivity (W/(m·K)) at room temperature of the low thermally-conductive material.

3. The socket installation structure as claimed in claim 2, wherein the thickness L (mm) of the layer satisfying the formula 1 is a length including a socket axis directional length variation ΔL (mm) which is determined according to an angle θ (degree) of the face of the first flange located on the side of the inward end and in contact with the article body through the sealing material, with respect to an axis direction of the socket, and a length variation Δt (mm) of a thickness of the sealing material between the face of the first flange on the side of the inward end and the article body, in a direction perpendicular to the face of the first flange on the side of the inward end.

4. The socket installation structure as claimed in claim 3, wherein the ΔL satisfies the following formula 2:

$$\Delta L \leq 5.76 \times \Delta t / \sin\theta \quad \text{Formula 2.}$$

5. The socket installation structure as claimed in claim 3, wherein the ΔL is 23 mm or less, and the L is 43 mm or less.

6. The socket installation structure as claimed in claim 1, wherein the low thermally-conductive material is a material having a thermal conductivity at room temperature of 2.5 (W/(m·K)) or less.

7. The socket installation structure as claimed in claim 1, wherein the low thermally-conductive material is a material having a thermal conductivity at room temperature of 0.5 (W/(m·K)) or less.

8. The socket installation structure as claimed in claim 1, wherein the low thermally-conductive material is air.

9. The socket installation structure as claimed in claim 1, wherein each of the face of the first flange on the side of the inward end, and a face of the article body in contact with the face of the first flange through the sealing material, has a conical shape which extends from its starting point on an inward side toward an outward side of the gas induction through-hole, at an angle of greater than 0 degree to less than 90 degrees with respect to a central axis of the gas introduction through-hole.

* * * * *